US006131061A

United States Patent [19]

DenBraber et al.

[11] Patent Number: 6,131,061

[45] Date of Patent: Oct. 10, 2000

[54] APPARATUS AND METHOD FOR PREVENTING UNDERDIGGING OF A WORK MACHINE

[75] Inventors: Lee R. DenBraber; John D. Duffy, both of Peoria; Mark R. Hawkins, Chillicothe; Steven J. Zmuda, Dunlap, all of Ill.

[73] Assignee: Caterpillar Inc., Peoria, Ill.

[21] Appl. No.: 08/888,855

[22] Filed: Jul. 7, 1997

[51] Int. Cl.[7] ..... G06F 19/00; E02F 3/34

[52] U.S. Cl. ..... 701/50; 37/348

[58] Field of Search ..... 701/50; 37/348

[56] References Cited

U.S. PATENT DOCUMENTS

| | | | |
|---|---|---|---|
| 5,065,326 | 11/1991 | Sahm | 364/424.07 |
| 5,088,020 | 2/1992 | Nishida et al. | 364/160 |
| 5,333,533 | 8/1994 | Hosseini | 91/361 |
| 5,404,661 | 4/1995 | Sahm et al. | 37/348 |
| 5,446,980 | 9/1995 | Rocke | 37/348 |
| 5,446,981 | 9/1995 | Kamada et al. | 37/348 |
| 5,535,532 | 7/1996 | Fujii et al. | 37/348 |
| 5,735,065 | 4/1998 | Yamagata et al. | 37/348 |
| 5,822,891 | 10/1998 | Fujishima et al. | 37/348 |

FOREIGN PATENT DOCUMENTS

| | | | |
|---|---|---|---|
| 0711876 | 5/1996 | European Pat. Off. | E02F 3/42 |
| 9-078632 | 3/1997 | Japan . | |
| 2272204 | 5/1994 | United Kingdom | E02F 3/43 |
| 2275462 | 8/1994 | United Kingdom | E02F 3/43 |

*Primary Examiner*—William A. Cuchlinski, Jr.
*Assistant Examiner*—Ronnie Mancho
*Attorney, Agent, or Firm*—Byron G. Buck, II

[57] ABSTRACT

A method and apparatus for preventing underdigging of a work machine, which may occur if the implement digs under or too close to the work machine, is disclosed. An underdigging boundary or a space of allowable implement movement is established relative to the work machine. The position of the implement is sensed, and the movement of the implement is controllably prevented from underdigging the work machine.

19 Claims, 7 Drawing Sheets

APPARATUS AND METHOD FOR PREVENTING UNDERDIGGING OF A WORK MACHINE

TECHNICAL FIELD

This invention relates generally to a method and apparatus for preventing underdigging of a work machine, and more particularly to establishing at least one underdigging boundary for controllably preventing the implement movement from underdigging the work machine.

BACKGROUND ART

Work machines having an attached implement, such as excavators, mining shovels, backhoes, wheel loaders and the like, are used for moving earth. Such implements may include buckets, impact rock rippers, and other material handling apparatus. The typical work cycle associated with a bucket includes sequentially positioning the bucket and associated lift arm in a digging position for filling the bucket with material, a carrying position, a raised position, and a dumping position for removing material from the bucket.

Currently, on many track type excavators, it is possible to damage the machine if the bucket movement is not controlled properly. This damage is due to the bucket digging under or too close to the tracks when the operator attempts to dig. Likewise, damage to a backhoe will occur when an operator directs the bucket to dig prior to moving the tires away from the digging zone. In these examples, the movement of the implement may cause the grade the work machine is sitting on to collapse, and might cause damage to the work machine.

It is undesirable to limit the flexibility of an implement by mechanically limiting its range of motion. Although this would prevent the damage from occurring, it could potentially limit the functionality of the work machine.

Currently, the machine operator must insure that the implement is properly operated to prevent underdigging the work machine. In the normal operation of a work machine many events are occurring simultaneously. This increases the potential for operator error, including the risk of allowing the implement to underdig the work machine.

The present invention is directed to overcoming one or more of the problems as set forth above.

DISCLOSURE OF THE INVENTION

In one aspect of the present invention, an apparatus for controllably preventing the underdigging of a work machine is provided. The work machine includes an implement and a controller. An underdigging boundary, is established in a predetermined pattern from at least a portion of the work machine. At least one position sensor associated with the implement is adapted to produce a sensed position of the implement signal. The controller is adapted to deliver a modified desired position signal to the implement, dependent on the difference between the sensed position of the implement signal and the underdigging boundary values.

In another aspect of the present invention, a method for preventing underdigging of a work machine is provided. An implement is connected to the work machine, and an underdigging boundary relative to the work machine is established. The position of the implement is sensed and is compared to the underdigging boundary location. Additionally, the implement is controllably prevented from traversing the underdigging boundary.

In another aspect of the present invention, a method for preventing underdigging of a work machine is provided. An implement is connected to the work machine, a space of allowable implement movement is established. The position of the implement is sensed and is compared to the space of allowable implement movement. Based on the comparison, the implement is prevented from leaving the space of allowable implement movement and underdigging the work machine.

These and other aspects and advantages of the present invention will become apparent to those skilled in the art upon reading the detailed description of the best mode for carrying out the invention in connection with the drawings and appended claims.

BRIEF DESCRIPTION OF THE DRAWINGS

For a better understanding of the invention, reference may be made to the accompanying drawings, in which.

BEST MODE FOR CARRYING OUT THE INVENTION

Figure 1:
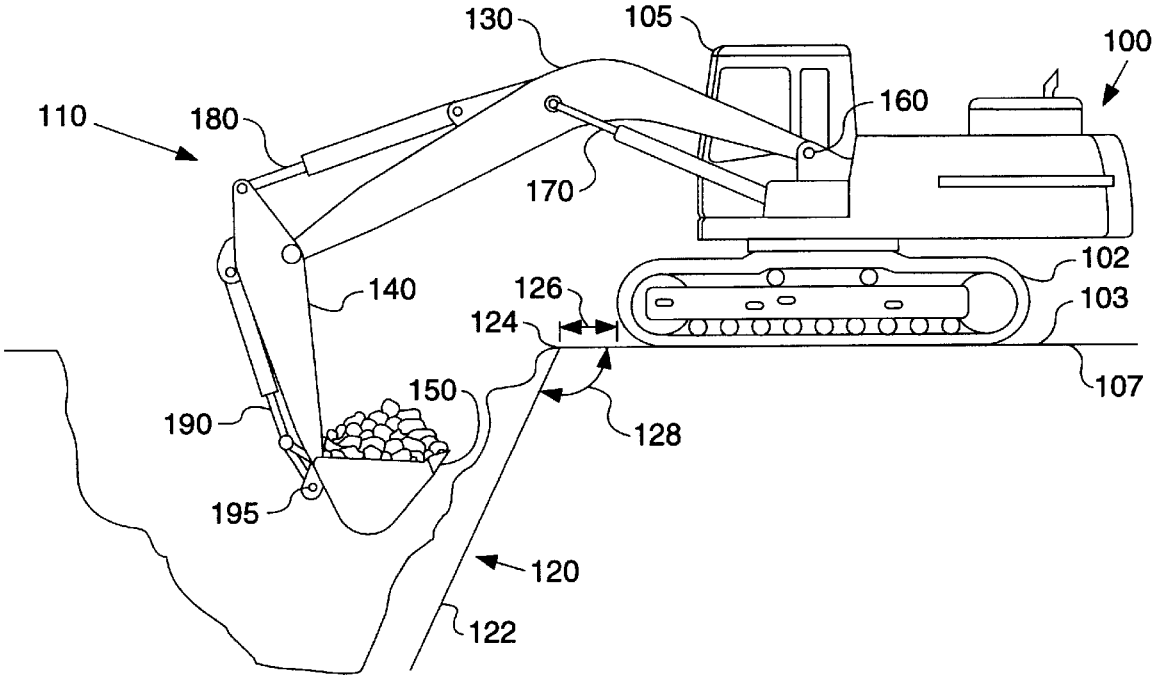
FIG. 1 is a cross-sectional view taken along line 1—1 of FIG. 5 of an embodiment of a work machine that may use the present invention.

A preferred embodiment of the present invention provides an apparatus and method for preventing underdigging of a work machine 100. The following description uses an excavator 105 having tracks 102 as an example only. This invention can be applied to other types of work machines 100 having an implement 110 and wheels instead of tracks 102. Other examples include mining shovels, wheel loaders, backhoes and the like. Similarly, the following description uses a bucket 150 as an example. However, other devices such as an impact rock ripper may be used.

In FIG. 1, an implement 110 is connected to a work machine 100, and an underdigging boundary 120 is located in a predetermined pattern relative to at least a portion of the work machine 100. The location of the underdigging boundary 120 shown in FIG. 1 is representative of a possible location. Other advantageous and preferred locations are discussed below.

The implement 110 of the excavator 105 typically includes a boom 130, stick 140, and bucket 150. The boom 130 is typically mounted on the work machine 100 by means of a boom pin 160. The stick 140 is connected to the free end of the boom 130, and the bucket 150 is attached to the stick 140. The boom 130, stick 140 and bucket 150 are independently and controllably actuated by respective linearly extendable hydraulic cylinders 170,180,190. The bucket 150 is directly actuated by the bucket hydraulic cylinder 190 and typically has a pivotal range of motion about a stick to bucket pivot pin 195.

Figure 2:
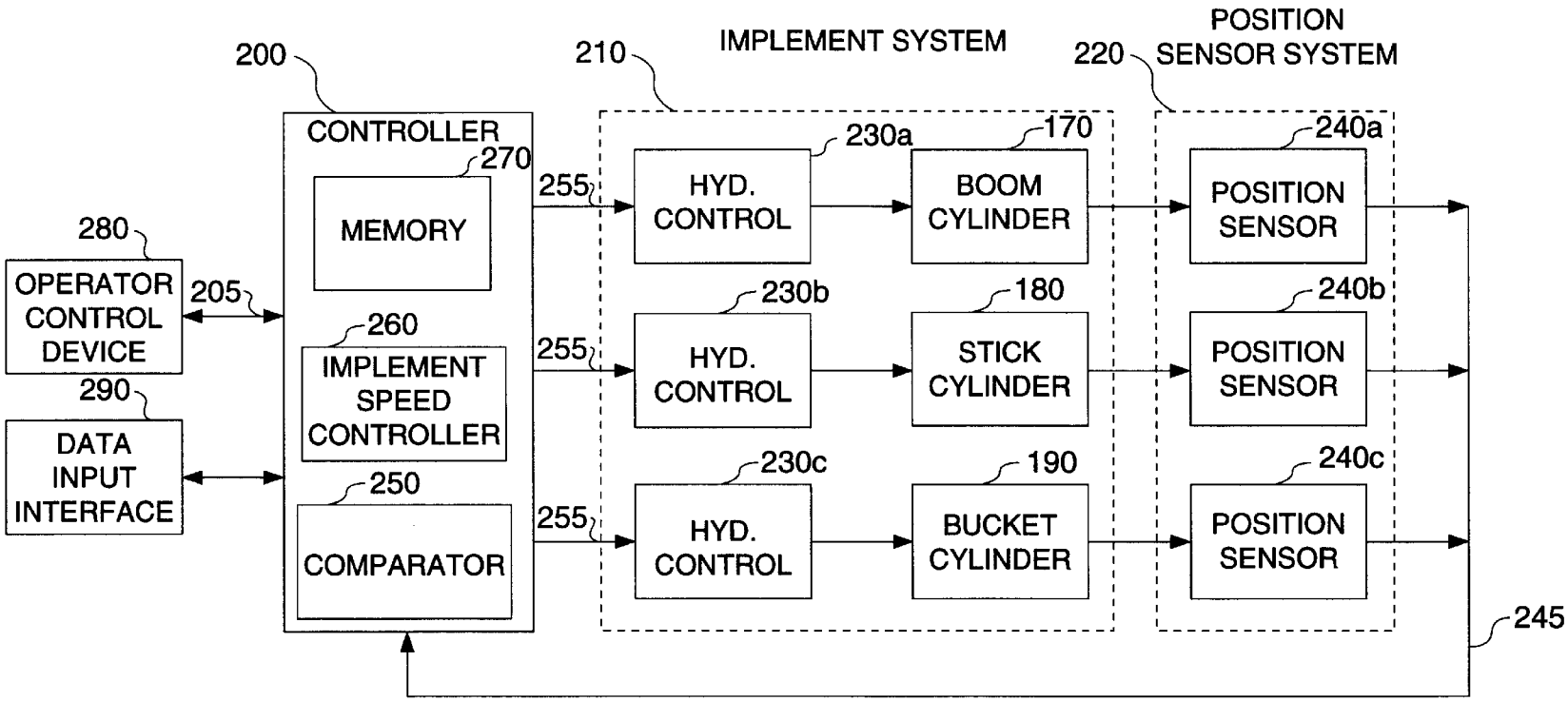
FIG. 2 is a system level block diagram of an embodiment of the invention.

In FIG. 2, the work machine 100 includes a controller 200 sufficient to deliver a desired position signal 205 to an implement system 210 and a position sensor system 220 having at least one position sensor 240*a*,240*b*,240*c*, associated with the implement 110. Preferably, the position sensor is a displacement sensor and a displacement sensor 240*a*, 240*b*, 240*c* is associated with each of the boom 130, stick 140 and bucket 150. The controller 200 has a memory 270 in communication with it and the memory 270 has the underdigging boundary data values 305 stored 310 in it. Preferably, a comparator 250 is associated with the controller 200. The controller 200 is adapted to receive a sensed position of the implement signal 245 from the position sensor 240*a*,240*b*,240*c*. The comparator 250 is adapted to deliver a prevent entry signal 340 to the controller which causes the controller to deliver a modified desired position signal 255 to the implement 110.

Figure 3:
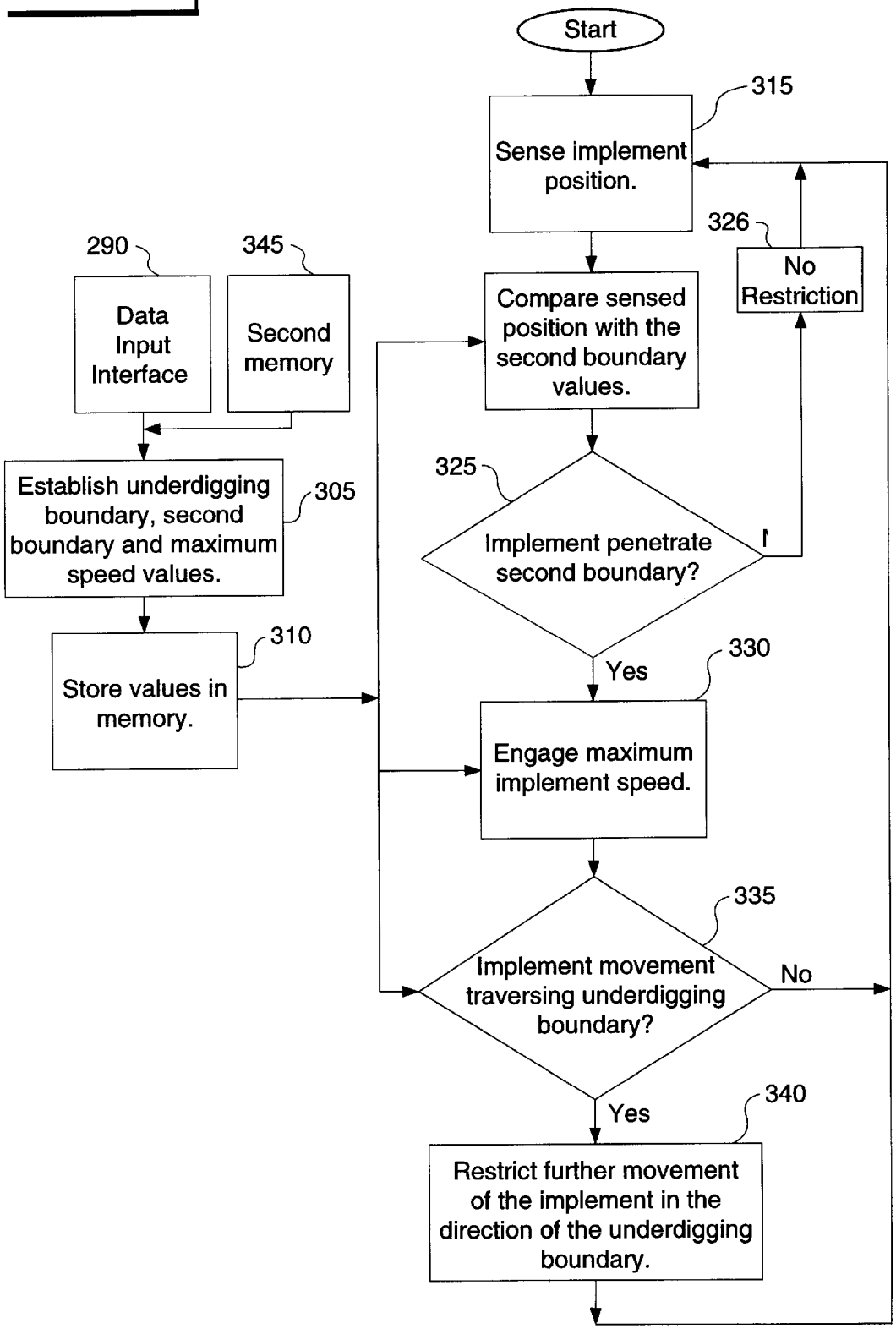
FIG. 3 is a flowchart illustrating an embodiment of the software implemented by the controller.
Figure 4:
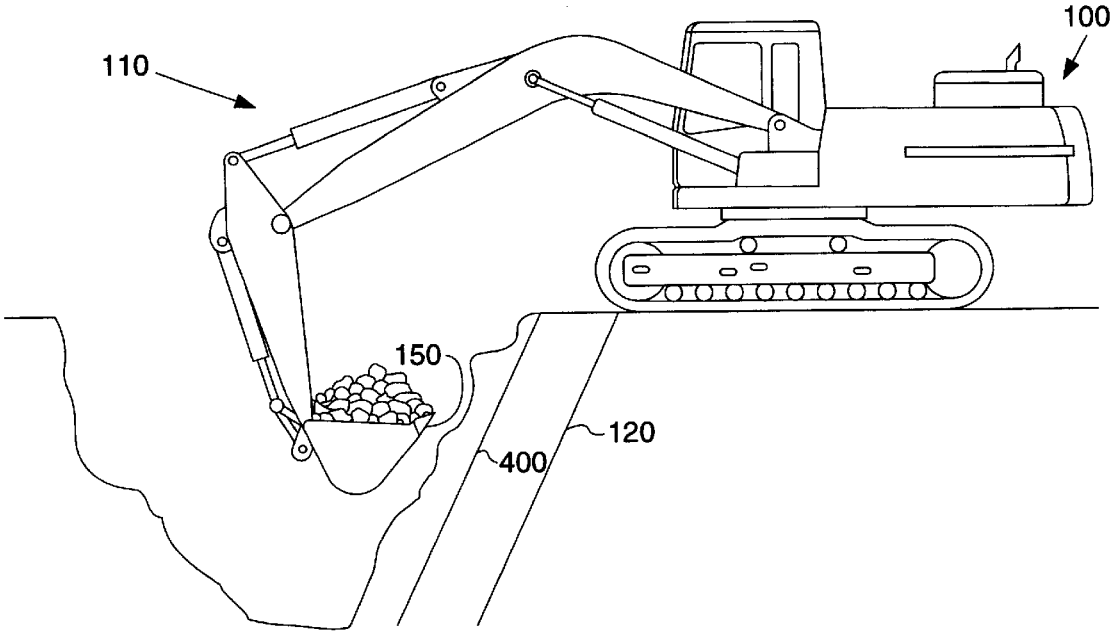
FIG. 4 is a cross-sectional view taken along line 1—1 of FIG. 5 of an embodiment of a work machine that may use the present invention.

Referring to FIG. 3, in a preferred embodiment, the electronic controller 200 is a 68336 microcontroller manufactured by Motorola Inc. located in Schaumburg, Ill. However, other suitable microcontrollers are known in the art, any one of which could be readily and easily used in connection with an embodiment of the present invention. Those skilled in the art can readily and easily write the specific program code from the flowchart, shown in FIG. 3, using the specific assembly language or microcode for the selected microcontroller.

Now, referring to FIGS. 2–5, and particularly to FIG. 3, in a preferred embodiment of the invention, a second boundary 400 is established 305 relative to the underdigging boundary 120 and is stored 310 in the memory 270. Additionally, the underdigging boundary values 305 and an implement speed limit 332 are established 305 and stored 310 in the memory 270. The implement speed limit 332 limits and reduces the speed of movement of the implement 110 between the second boundary 400 and the underdigging boundary 120. The sensor 240 senses the position of the implement 110, and produces a sensed position of the implement signal 245. In a first decision block 325, the controller 200 compares the sensed position of the implement signal 245 with the second boundary values 320. If the implement is not penetrating the second boundary 400, then no restriction 326 is produced.

However, in response to a determination in the first decision block 325 that the implement is penetrating the second boundary 400 and moving between the second boundary 400 and the underdigging boundary 120 the implement speed limit 332 is engaged. The implement speed limit 332 continues to be engaged while the sensed position of the implement 110 is between the underdigging boundary 120 and the second boundary 400.

In a second decision block 335, the position of the implement 110 with respect to the work machine 100 is compared with the underdigging boundary values 305. The desired position of the implement signal 205 is controllably modified by the controller 200 to prevent the implement movement from traversing the underdigging boundary 120 by restricting 340 any further movement in the direction of the underdigging boundary 120.

Referring again to FIG. 2, preferably an operator control device 280 provides input to the controller 200. The operator control device 280 provides manual control of the work implement 110. As is well known in the art, the desired position signal 205 of the operator control device 280 represents the operator's desired movement of the implement 110. The controller 200 coordinates the movements of the boom 130, stick 140 and bucket 150 to conform to movements of the operator control device 280.

Advantageously, a data input interface 290 is connected to the controller 200. The data input interface 290 may be a liquid crystal display, console, keyboard, pushbuttons, voice recognition devices, other interfaces well known in the art or, preferably, a laptop computer. Preferably, the data input interface 290 is adapted to permit the operator to input the underdigging boundary 120, the second boundary 400, and the implement speed limit 332. However, in a specific embodiment the underdigging boundary values 305 are provided by transferring them from a second memory 345. This could be performed at the factory, by a dealer or end user, or in the field. In another specific embodiment, the underdigging boundary values 305 are provided by sensing and recording at least one location 720 of the implement 110 with respect to the work machine 100. This one location 720 defines the underdigging boundary 120.

Referring to FIG. 1, a work machine 100 is setting on a surface 103 having a grade 107. In a specific embodiment of the present invention the predetermined pattern of the underdigging boundary 120 is a half plane 122 having a top periphery 124 common with the grade 107. The half plane 122 could be curved. In a specific embodiment, the top periphery 124 is a predetermined distance 126 from the work machine 100. Further, the half plane 122 is angularly disposed from the periphery 124 with respect to the grade 107. The angle 128 could range from about 0 to about 180 degrees, but is preferably between 90 and 150 degrees.

Figure 6:
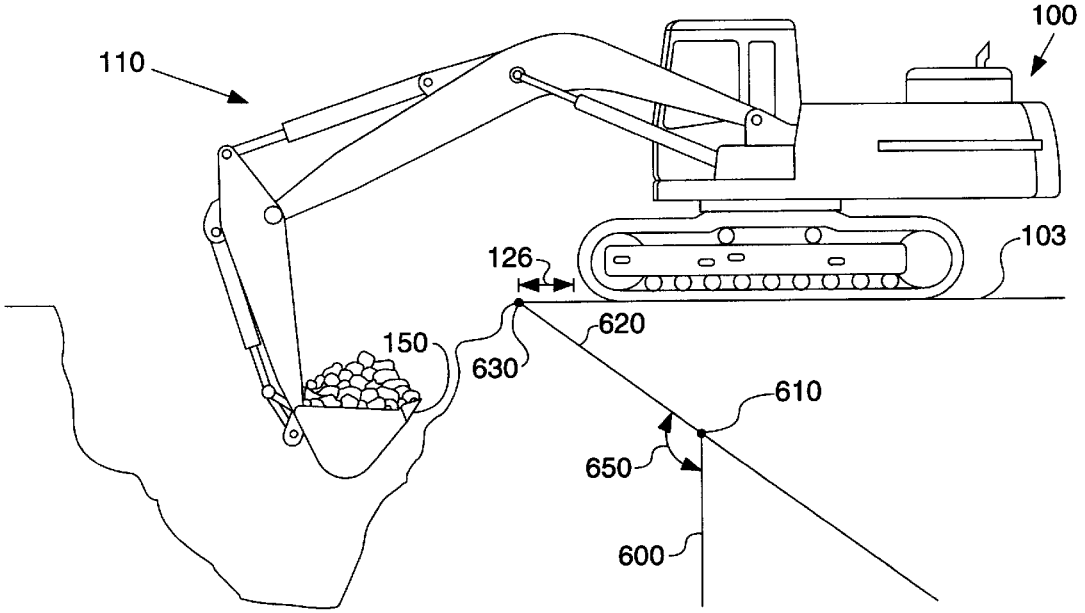
FIG. 6 is a cross-sectional view taken along line 1—1 of FIG. 5 of an embodiment of a work machine that may use the present invention.

Referring to FIG. 6, in a specific embodiment, the predetermined pattern of the underdigging boundary 120 is a combination of a first half plane 600 and a second half plane 620. The first or second half planes 600, 620 could be curved. The first half plane 600 has a top periphery 610 disposed below and relative to the work machine 100. The second half plane 620 has a perimeter 630 and extends from the perimeter 630 and intersects the top periphery 610. The perimeter 630 is angularly disposed from the periphery 610 with respect to the first half plane 600, and in a specific embodiment, the perimeter 630 is a predetermined distance 126 from the work machine 100. The angle 650 could range from about 0 to about 180 degrees, but is preferably between 90 and 150 degrees.

Figure 5:
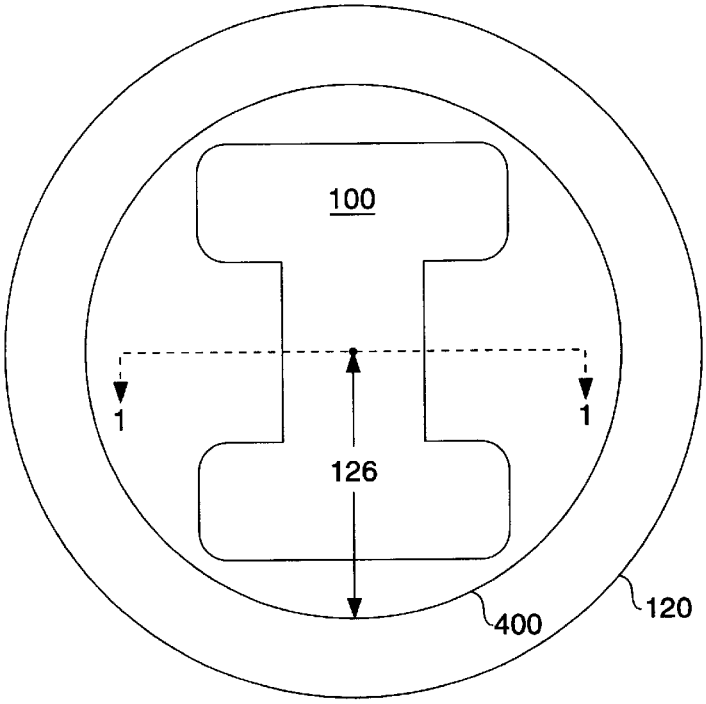
FIG. 5 is a diagrammatic top view of a work machine that may use the present invention.
Figure 7:
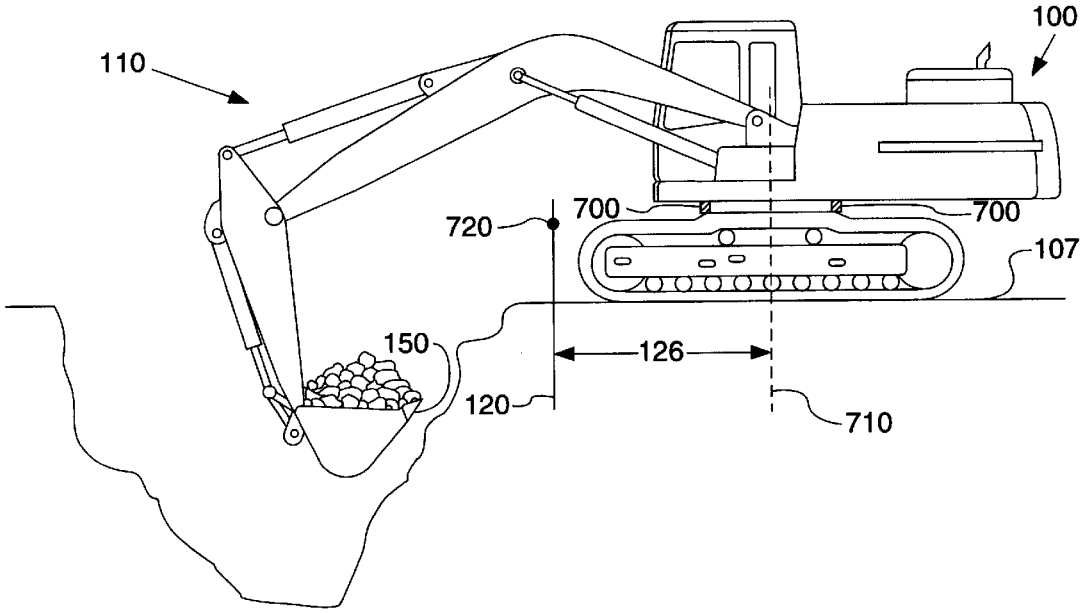
FIG. 7 is a cross-sectional view taken along line 1—1 of FIG. 5 of a preferred embodiment of a work machine that may use the present invention.

Referring to FIGS. 5 and 7, in a preferred embodiment the work machine 100 has a swing pin 700 having a longitudinal axis 710. Additionally, the underdigging boundary 120 is located a predetermined distance 126 from the longitudinal axis 710.

Figure 8:
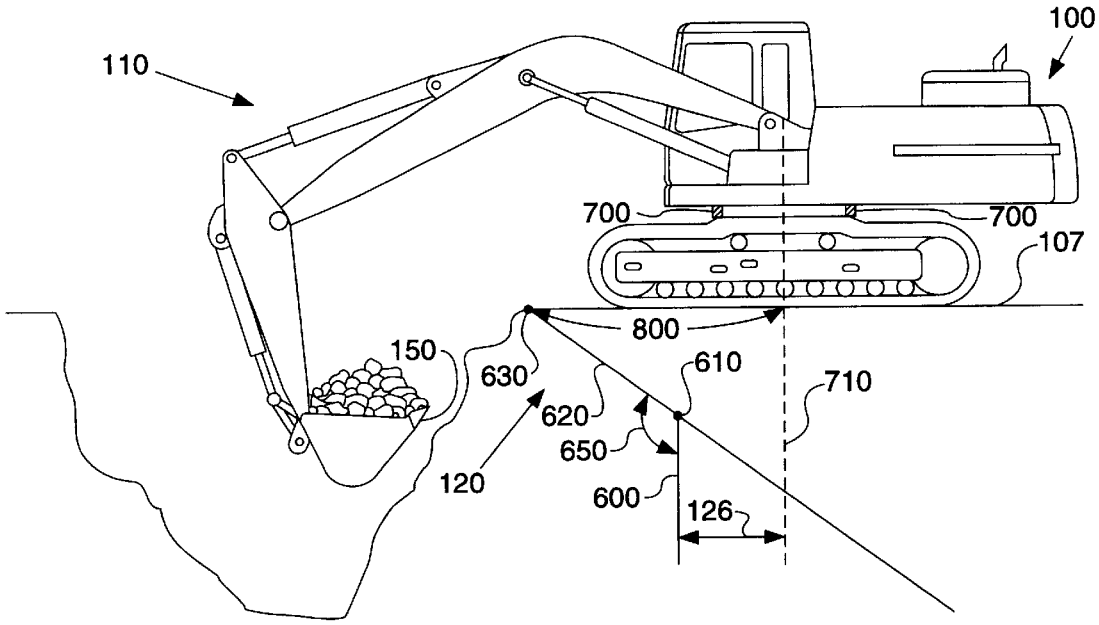
FIG. 8 is a cross-sectional view taken along line 1—1 of FIG. 5 of an embodiment of a work machine that may use the present invention.

Referring to FIG. 8, the work machine 100 has a swing pin 700 having a longitudinal axis 710. The predetermined pattern of the underdigging boundary 120 is a combination of a first half plane 600 having a top periphery 610 and a second half plane 620 having a perimeter 630. Preferably, the first and second half planes 600,620 are curved. The first half plane 600 is disposed below the work machine 100 and a predetermined distance 126 from the longitudinal axis 710. The second half plane 620 extends from the perimeter 630 and intersects the top periphery 610. The perimeter 630 is angularly disposed from the periphery 610 with respect to the first half plane 600 and is a second predetermined distance 800 from the longitudinal axis 710. The angle 650 between the perimeter 630 and the first half plane 600 could range from about 0 to about 180 degrees, but is preferably between 90 and 150 degrees.

Figure 9:
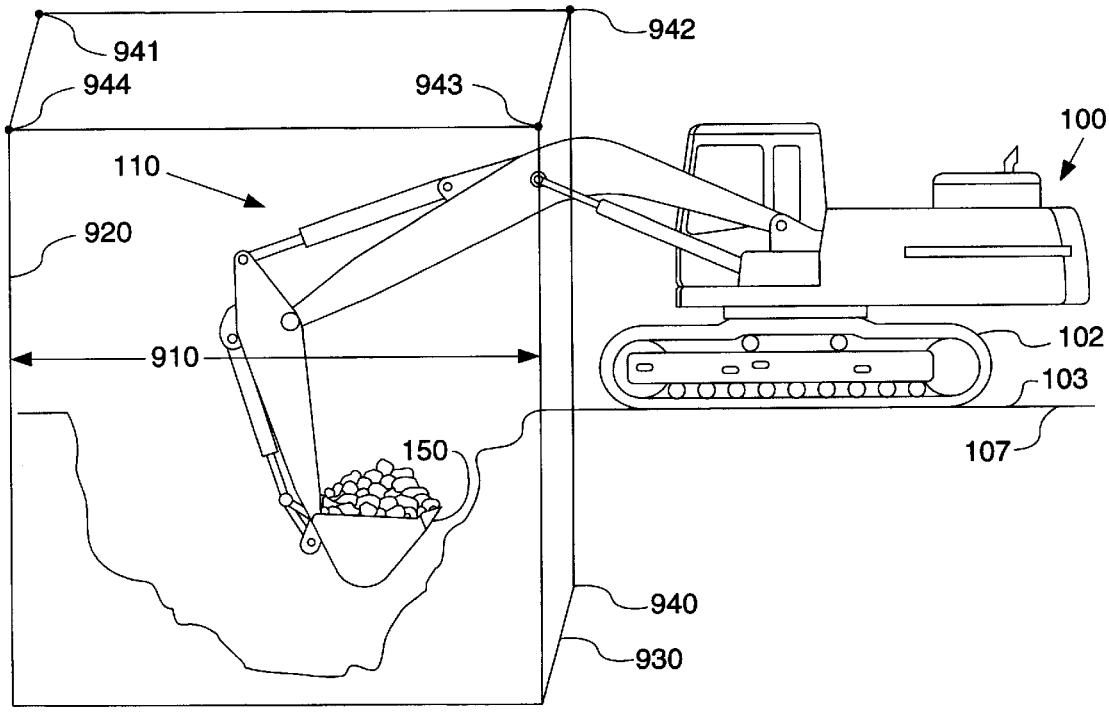
FIG. 9 is a cross-sectional view taken along line 1—1 of FIG. 5 of an embodiment of a work machine that may use the present invention.
Figure 10:
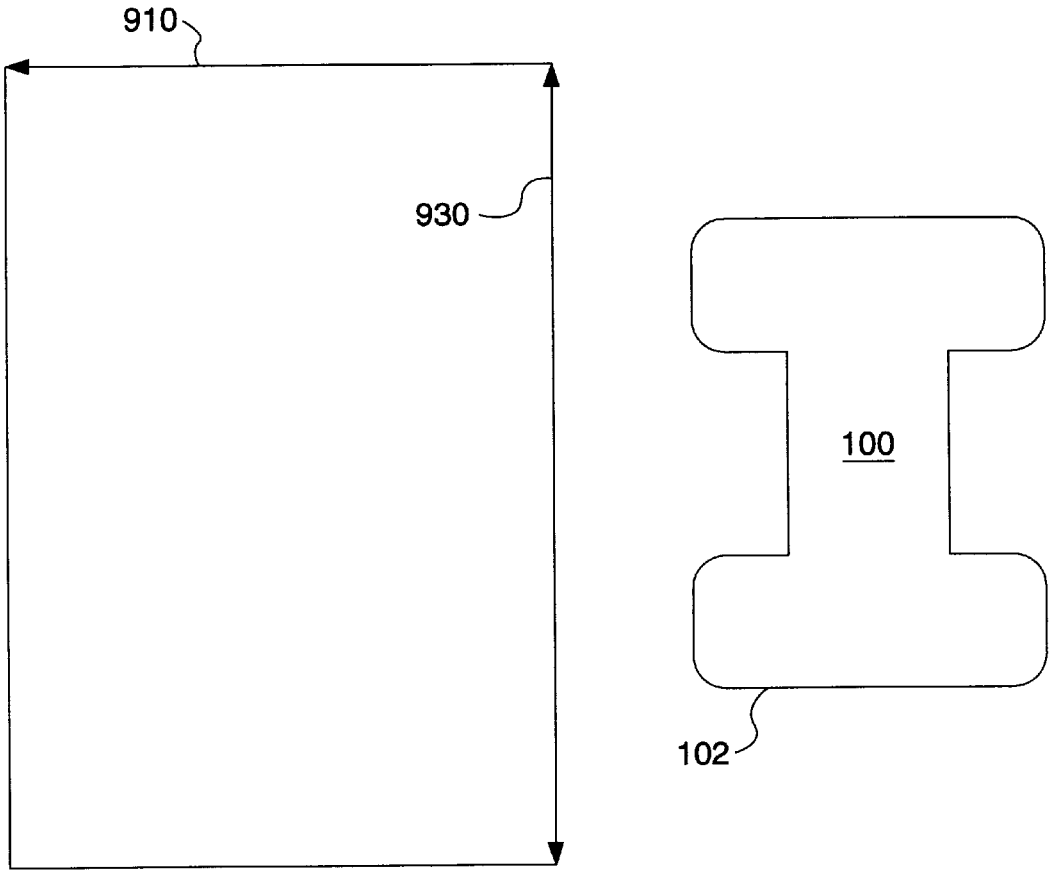
FIG. 10 is a diagrammatic top view of a work machine that may use the present invention.

Referring to FIGS. 9 and 10, another aspect of the present invention is shown with reference to a work machine 100 setting on a surface 103 having a grade 107. In a specific embodiment of the present invention the work machine 100 has an implement 110 connected to the work machine 100, a controller 200 that produces a desired position signal 205 and delivers the desired position signal 205 to the implement 110, and a memory 270 that is associated with the controller 200.

A space of allowable implement movement 900 is established relative to the work machine 100 and allowable implement movement data values (not shown) are stored in the memory 270. The space of allowable implement movement 900 will vary depending upon the stability of the surface 103 upon which the work machine 100 is setting. The range of the space of allowable implement movement 900 extends horizontally a first distance 910, preferably from the tracks 102 of the work machine 100 to the maximum reach of the implement 110. The range of the space of allowable implement movement 900 also extends vertically a second distance 920, preferably from the lowest reach of the implement 110 below the grade 107 of the work machine 100 to the highest reach of the implement 110 above the grade 107 of the work machine 100. Additionally, the range of the space of allowable implement movement 900 extends a third distance 930 that is preferably substantially perpendicular to the first and second distances 910, 920. Advantageously, the third distance 930 only extends along the area of digging and dumping of the bucket 150. However, the third distance 930 could extend partially or completely around the work machine 100 resulting in a space of allowable implement movement 900 that has substantially a torroidal geometry.

Further, the position of the implement 110 with respect to the work machine 100 is sensed. The sensed position of the implement signal 245 is compared with the allowable implement movement data values (not shown). If the implement is leaving the space of allowable implement movement 900, the desired position signal 205 is controllably modified to prevent the implement movement from leaving the space of allowable implement movement 900 and underdigging the work machine.

In a preferred embodiment a data input interface 290 is used to define the space of allowable implement movement 900. In a specific embodiment a plurality of locations 940,941,942,943,944 of the implement 110 with respect to the work machine 100 are sensed and recorded. The plurality of locations 940,941,942,943,944 define the space of allowable implement movement 900.

While aspects of the present invention have been particularly shown and described with reference to the preferred embodiment above, it will be understood by those skilled in the art that various additional embodiments may be contemplated without departing from the spirit and scope of the present invention. For example, a method or apparatus of the present invention may have an underdigging boundary 120 having a pyramid or other type of geometry. However, such a device or method should be understood to fall within the scope of the present invention as determined based upon the claims below and any equivalents thereof.

Industrial Applicability

Earth working machines 100 such as excavators include work implements 110 capable of being moved through a number of positions during a work cycle. The typical work cycle associated with a bucket 150 includes positioning the boom 130, stick 140 and bucket 150 in a digging position for filling the bucket 150 with material, a carrying position, a raised position, and a dumping position for removing material from the bucket.

The method and apparatus of certain specific embodiments of the present invention, when compared with other methods and apparatus, may have the advantages of preventing damage to the work machine 100 due to the collapse of the grade 107 resulting from movement of the implement 110, avoiding the undesirable effects of mechanically limiting the range of motion of the implement 110, and being more economical to use, maintain, and manufacture. Such advantages are particularly worthy of incorporating into the design, manufacture and operation of work machines 100. In addition, the present invention may provide other advantages that have not been discovered yet.

It should be understood that while the preferred embodiment is described in connection with the boom 130, stick 140, bucket 150 and associated electrical and hydraulic circuits, the present invention is readily adaptable to control the position of implements 110 for other types of earth working machines 100. For example, the present invention could be employed to control implements 110 on hydraulic mining shovels, backhoes, wheel loaders and similar machines having hydraulically operated implements 110.

Other aspects, objects and advantages of the present invention can be obtained from a study of the drawings, the disclosure and the appended claims.

What is claimed is:

1. An apparatus for controllably preventing the underdigging of a work machine by an implement connected to the work machine, comprising:

a memory;

an underdigging boundary, the underdigging boundary being represented by data values stored in the memory and the underdigging boundary being located in a predetermined pattern relative to at least a portion of the work machine, the work machine setting on a surface having a grade and the predetermined pattern of the underdigging boundary being a half plane having a top periphery common with the grade and being angularly disposed from the periphery with respect to the grade;

at least one position sensor associated with the implement, the position sensor being adapted to produce a sensed position of the implement signal; and a controller in communication with the memory, adapted to receive the sensed position of the implement signal and being adapted to develop a modified desired position signal in response to a comparison between the sensed position of the implement signal and the underdigging boundary.

2. An apparatus as set forth in claim 1, wherein the predetermined pattern of the underdigging boundary is a first half plane having a top periphery and being disposed below and relative to the work machine and a second half plane having a perimeter and extending from the perimeter and intersecting the top periphery, the perimeter being angularly disposed from the periphery with respect to the first half plane.

3. An apparatus as set forth in claim 1, wherein the work machine has a swing pin having a longitudinal axis and the underdigging boundary is a predetermined distance from the longitudinal axis.

4. An apparatus as set forth in claim 1, wherein the work machine has a swing pin having a longitudinal axis and the predetermined pattern of the underdigging boundary is a combination of a first half plane having a top periphery and being disposed below the work machine and a predetermined distance from the longitudinal axis and a second half plane having a perimeter and extending from the perimeter and intersecting the top periphery, the perimeter being angularly disposed from the periphery with respect to the first half plane and a second predetermined distance from the longitudinal axis.

5. An apparatus as set forth in claim 1, including a data input interface connected to the controller, the underdigging boundary values being established by using the data input interface.

6. An apparatus as set forth in claim 1, including a second boundary having values stored in the memory, the second boundary being located relative to the underdigging boundary.

7. An apparatus, as set forth in claim 6, wherein the controller includes an implement speed controller adapted to deliver an implement speed limit to the implement.

8. An apparatus, as set forth in claim 7, including a data input interface connected to the controller and adapted to establish the underdigging boundary, the second boundary, and the implement speed limit.

9. A method for preventing underdigging of a work machine having an implement, comprising the steps of:

establishing an underdigging boundary relative to the work machine by defining a half plane having a top periphery common with the grade a predetermined distance from the work machine and being angularly disposed from the periphery with respect to the grade, such that the implement movement is prevented from crossing the underdigging boundary;

sensing the position of the implement with respect to the work machine;

comparing the sensed position of the implement signal with the underdigging boundary; and controllably preventing the implement movement from traversing the underdigging boundary in response to the step of comparing the sensed position of the implement signal with the underdigging boundary.

10. A method, as set forth in claim 9, including the step of:

establishing an underdigging boundary by combining a first half plane having a top periphery and being disposed below and relative to the work machine and a second half plane having a perimeter and extending from the perimeter and intersecting the top periphery, the perimeter being a predetermined distance from the work machine and angularly disposed from the periphery with respect to the first half plane, such that the implement movement is prevented from crossing the underdigging boundary.

11. A method, as set forth in claim 9, wherein the work machine has a swing pin having a longitudinal axis and including the step of:

establishing an underdigging boundary a predetermined distance from the longitudinal axis.

12. A method, as set forth in claim 9, wherein the work machine has a swing pin having a longitudinal axis and including the step of:

establishing an underdigging boundary by combining a first half plane having a top periphery and being disposed below the work machine and a predetermined distance from the longitudinal axis and a second half plane having a perimeter, extending from the perimeter and intersecting the top periphery, the perimeter being angularly disposed from the periphery with respect to the first half plane and a second predetermined distance from the longitudinal axis, such that the implement movement is prevented from crossing the underdigging boundary.

13. A method, as set forth in claim 9, including the step of providing the underdigging boundary data values from a data input interface.

14. A method, as set forth in claim 9, including the step of transferring the underdigging boundary data values from a second memory.

15. A method, as set forth in claim 9, including the steps of sensing and recording at least one location of the implement with respect to the work machine, the at least one location defining the underdigging boundary data values.

16. A method, as set forth in claim 9, including the steps of:

establishing a second boundary relative to the underdigging boundary and storing the second boundary data values representing the second boundary in the memory;

establishing an implement speed limit between the second boundary and the underdigging boundary and storing the implement speed limit in the memory;

comparing the sensed position of the implement with the second boundary data values; and controllably engaging the implement speed limit in response to the step of comparing the sensed position of the implement signal with the second boundary data values.

17. A method for preventing underdigging of a work machine having an implement, comprising the steps of:

establishing a space of allowable implement movement relative to the work machine and storing allowable implement movement data values representing the space of allowable implement movement in memory;

sensing the position of the implement with respect to the work machine;

comparing the sensed position of the implement with the space of allowable implement movement; and controllably preventing the implement movement from leaving the space of allowable implement movement and underdigging the work machine in a predetermined manner.

18. A method, as set forth in claim 17, including the step of using a data input interface to define the space of allowable implement movement data values.

19. A method, as set forth in claim 18, including the steps of sensing and recording a plurality of locations of the implement with respect to the work machine, the plurality of locations defining the space of allowable implement movement data values.

* * * * *